US008463660B1

(12) United States Patent
White

(10) Patent No.: US 8,463,660 B1
(45) Date of Patent: Jun. 11, 2013

(54) SYSTEM AND METHOD FOR MANAGING LOTTING AND CATALOG DATA AND INTERFACE FOR THE SAME

(75) Inventor: Glenn M. White, Chestnut Hill, MA (US)

(73) Assignee: Lotting Solutions, LLC, Chestnut Hill, MA (US)

( * ) Notice: Subject to any disclaimer, the term of this patent is extended or adjusted under 35 U.S.C. 154(b) by 0 days.

(21) Appl. No.: 13/107,908

(22) Filed: May 14, 2011

Related U.S. Application Data

(60) Provisional application No. 61/345,058, filed on May 14, 2010.

(51) Int. Cl.
*G06Q 30/00* (2012.01)

(52) U.S. Cl.
USPC ..... 705/26.1; 705/27.1

(58) Field of Classification Search
USPC ..... 705/26, 27, 26.1, 27.1
See application file for complete search history.

(56) References Cited

U.S. PATENT DOCUMENTS 7,895,115 B2 * 2/2011 Bayyapu et al. ..... 705/37
8,315,921 B2 * 11/2012 Hallowell et al. ..... 705/27.1
2004/0128224 A1 * 7/2004 Dabney et al. ..... 705/37
2005/0114229 A1 * 5/2005 Ackley et al. ..... 705/26
2006/0106683 A1 * 5/2006 Fisher et al. ..... 705/27
2006/0107224 A1 * 5/2006 Friend et al. ..... 715/764
2007/0011082 A1 * 1/2007 Lynch ..... 705/37

OTHER PUBLICATIONS

"Your Kids Old Stuff: Sell it Online" (Good Housekeeping. Anonymous. Mar. 2005).*

* cited by examiner

*Primary Examiner* — Courtney Stopp
(74) *Attorney, Agent, or Firm* — Loginov & Associates, PLLC; Keri E. Sicard; William A. Loginov

(57) ABSTRACT

A system, method and interface for managing lotting or catalog data pertaining to assets for sale, cataloging or acquisition at an auction event. Auctioneers provide auction and lot data, and a lotter is assigned to gather data pertaining to the assets. A system server has a template application running thereon for providing a template and form fields corresponding to the asset type as specified by a lotter. The system provides standardized forms for gathering asset data, and similar data fields are provided for similar asset types. An interactive portal provides users with auction data and the generated forms for gathering data during the lotting process. The interactive portal includes an options screen, overview screen, lotting screen and auction screen for performing the various lotting management.

17 Claims, 6 Drawing Sheets

SYSTEM AND METHOD FOR MANAGING LOTTING AND CATALOG DATA AND INTERFACE FOR THE SAME

RELATED APPLICATIONS

This application claims the benefit of U.S. Provisional Application Ser. No. 61/345,058, filed May 14, 2010, entitled SYSTEM AND METHOD FOR MANAGING LOTTING DATA AND INTERFACE FOR THE SAME, the entire disclosure of which is herein incorporated by reference.

FIELD OF THE INVENTION

The present invention relates to systems and methods for cataloging and managing asset data, lotting data and overall auction organization.

BACKGROUND OF THE INVENTION

To organize and gather information for a particular process, event, auction, appraisal or other auction-type sale of assets, an auctioneer or other desired party obtains information pertaining to the assets. This is typically obtained by a lotter, cataloger or other data gatherer, who reviews the assets for pertinent data to properly describe, take pictures and associate an image to lot or catalog the item and identify the asset. Each asset requires particular data to be gathered and organized by the lotter and/or auctioneer. Lotters or catalogers, individuals who lot assets for sale, gather asset data for each asset and are generally experienced in the field of asset identification, cataloging and lotting. Unfortunately there is no mechanism for standardizing data gathered for an asset or organizing data into a convenient interface. Additionally, the lotter, cataloger or gatherer of asset data, gathers the data once, and data is often re-entered and re-read multiple times. This disadvantageously results in misread or mis-entered data, mischaracterized assets and unfortunate degrouping of data for a particular asset. Furthermore, images typically have to be re-named multiple times for some auctions. Images can become disassociated with an asset, or lost altogether.

Under prior systems for managing lotting data, there is no generalized method or mechanism for gathering asset data and images. Thus the lotter or cataloger is thus required to remember which data is gathered for an asset and other pertinent information. This data gathered by the lotter is typically entered into a multitude of systems and re-entered numerous times before the data is actually paired back up with the asset. Asset data collection most often includes collecting one or multiple pictures that need to be associated with the asset by re-naming the image for association with said asset. A photograph of the asset also needs to be organized with the collected asset information, and this can often become lost or provided with an incorrect asset identification according to prior systems.

There is a need for a system that provides users with various elements and techniques that improve the efficiency of handling lotting or catalog data and applying it to differing computer systems.

SUMMARY OF THE INVENTION

This invention overcomes disadvantages of the prior art by providing a system, method, and interface for managing lotting, catalog and asset data collection relating to an auction or other asset data collection processes such as banking and financial asset lending, appraisals and asset inventory collection. The system includes a system server for managing and otherwise generating information relating to an event, asset data collection and the lotting/cataloging of auction/event assets in an organized and efficient manner. Additionally, the system server includes and/or controls processes for importing from or exporting data to multiple disparate IT systems that import same data elements and images in differing formats with different naming conventions for data. More particularly, the system and method advantageously provides an interface for gathering pertinent data relating to a particular asset according to a standardized template; an automated process for collecting data about an asset and associating multiple images and attribute data to that asset; and an automated procedure for exporting a complete data set to multiple computer systems that accept different import formats. The system also provides asset data attributes from which, lotting data, catalog and/or auction data to interested individuals will be accessible through an interactive portal. Moreover, the system further provides uniform data gathering and similar data fields for similar assets.

In an illustrative embodiment, the system server has a plurality of applications running thereon. One application is a template procedure to determine appropriate data fields for each of the assets, to produce forms having similar data fields for substantially similar assets. The system server is in communication with a system database that stores the asset data. An interface display for providing and obtaining asset data includes an overview portion with unified views and collection of all data for an asset, a data gathering portion and an images portion. The system provides a portal to access and display data pertaining to an asset.

In the illustrative embodiment, a method for managing asset data for acquisition or sale of the asset provides an asset type, receives a plurality of data field entries and uploads asset data. Further, a method for generating a form to gather asset data obtains asset type provides output points and generates input fields to create the form. Additionally, a method for gathering data regarding assets inputs asset types and provides data into input fields to provide an overall data file for a particular asset.

BRIEF DESCRIPTION OF THE DRAWINGS

The invention description below refers to the accompanying drawings, of which.

DETAILED DESCRIPTION

A system and method for managing asset data for the sale, cataloging, acquisition or other disposition of an asset streamlines communication between system parties and gathering of assets and associated data. The system is readily applicable to any asset and associated data gathering system and procedure.

Figure 1:
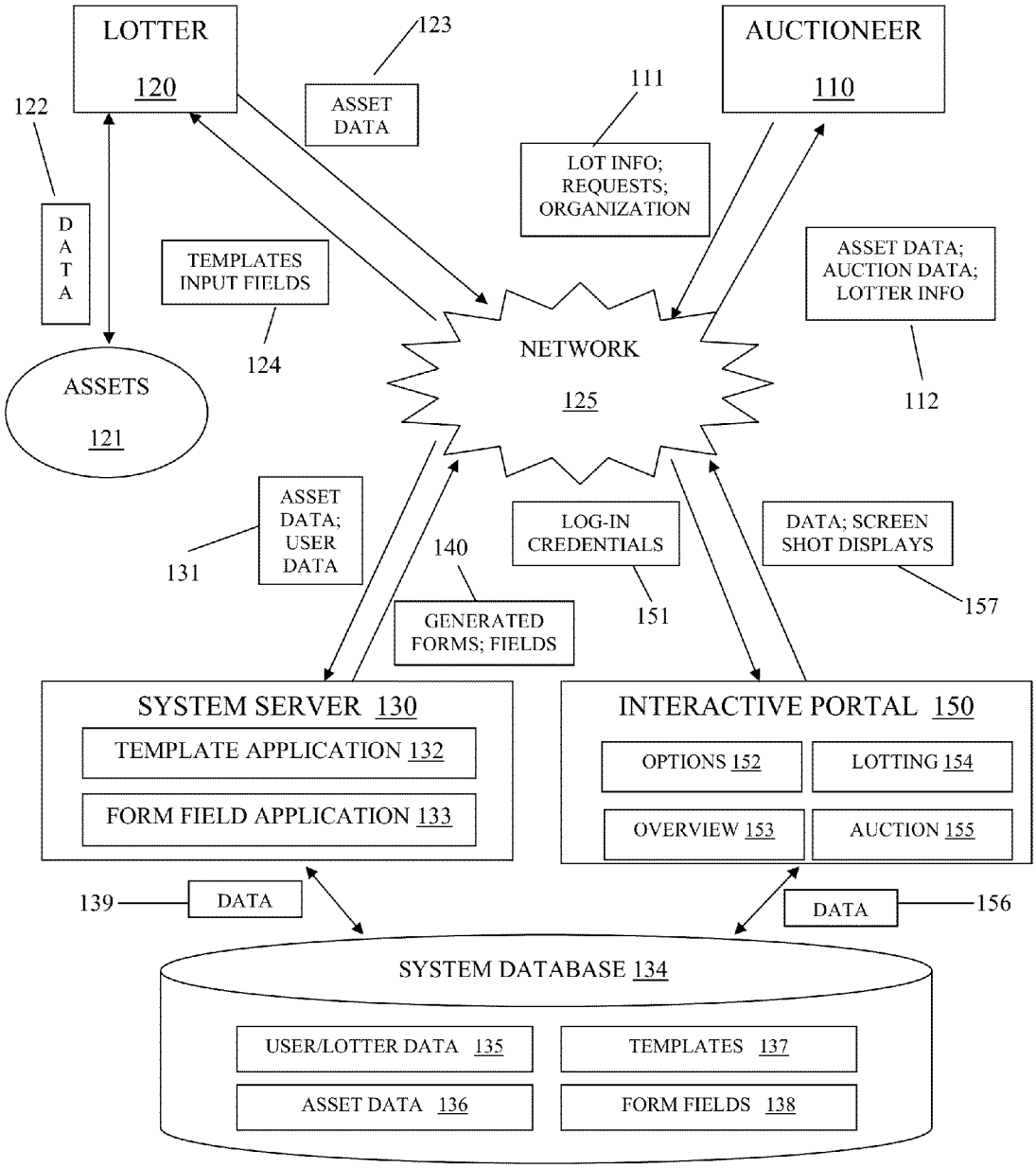
FIG. 1 is an overview block diagram of a system for managing lotting data in accordance with an illustrative embodiment.

FIG. 1 is an overview block diagram of an asset and auction management system 100 according to an illustrative embodiment. An auctioneer 110 and a lotter 120 are in communication through an appropriate network 125 to perform management and other tasks associated with the cataloging, auction and lotting process. Auctioneers, catalogers, appraisers and lotters are parties or individuals commonly participating in the catalog creation, sale or acquisition of assets through an auction environment. These are only exemplary parties, and can be substituted for any parties participating in the lotting, cataloging and related management of assets, as readily apparent to those having ordinary skill. The network through which the various parties communicate can be any appropriate network, including but not limited to a local area network (LAN), wireless local area network (WLAN), wide area network (WAN), appropriate cell phone communication networks, the broad world-wide Internet, or other appropriate interconnections to the Internet using access points over a wireless network.

In accordance with an illustrative embodiment, an auctioneer 110 (or other data gatherer) transmits lot information, requests for assets and other general organization for an auction or cataloging event via datastream 111 through the network 125. The auctioneer can enter a number for the auction or cataloging event, description, location, title and date for the auction and/or assets. Asset data, auction data and lotter info is returned to the auctioneer 110 via datastream 112. A lotter 120 can be assigned by the auctioneer or as an independent third party that performs the lotting of assets 121 for a particular auction event. The lotter typically, though not always, is assigned to a group of assets at a particular location, and thus is in charge of a plurality of assets 121. The lotter 120 gathers data 122 pertaining to the assets, including the type of asset. This data is transmitted via datastream 123 through the network 125 and to the system server 130. The system server can comprise any appropriate computers and/or applications, including a server distributed as a series of computers, a cloud of computers, and a plurality of applications provided in one or more computing devices. The asset type is used by the system server to generate forms and/or form fields, depending on the particular asset selected. The templates and input fields are transmitted to the lotter 120 via datastream 124 such that they know which data to gather pertaining to the asset, and it can be all organized into a single form having all pertinent data. A photograph can also be obtained directly on the form for gathering data.

The system server 130 receives asset data and user data via datastream 131 to correctly identify the particular user, as well as the asset to be lotted. The system server 130 has appropriate applications and other programs running thereon for asset management in accordance with the illustrative embodiment. The asset data is used by the template application 132 and form field application 133 to, respectively, determine appropriate templates for data gathering and form fields for data gathering. Data is stored in a system database 134 and transmitted therebetween via datastream 139. The system database 134 includes user/lotter data 135 corresponding to particular lotters of the system; asset data 136 which corresponds to particular assets that have been or are ready to be lotted; templates 137 which comprises templates for data gathering of a particular asset; and form fields 138 which comprises the fields generated by the form field application. The templates and form fields generated by the system server are transmitted via datastream 140 through the network to the appropriate auctioneer 110, lotter 120 or online portal 150 as desired for data gathering.

A user desiring to access the interactive portal 150 transmits log-in credentials via datastream 151. The portal 150 has a plurality of portions, and includes an options screen 152, overview screen 153, lotting or catalog screen 154, and auction screen 155. The interactive portal similarly stores data via datastream 156 into the system database 134. Data pertaining to a particular auction, lot and/or asset, along with screen shot displays, are transmitted via datastream 157 through the network 125 to the appropriate user, lotter or auctioneer.

Figure 2:
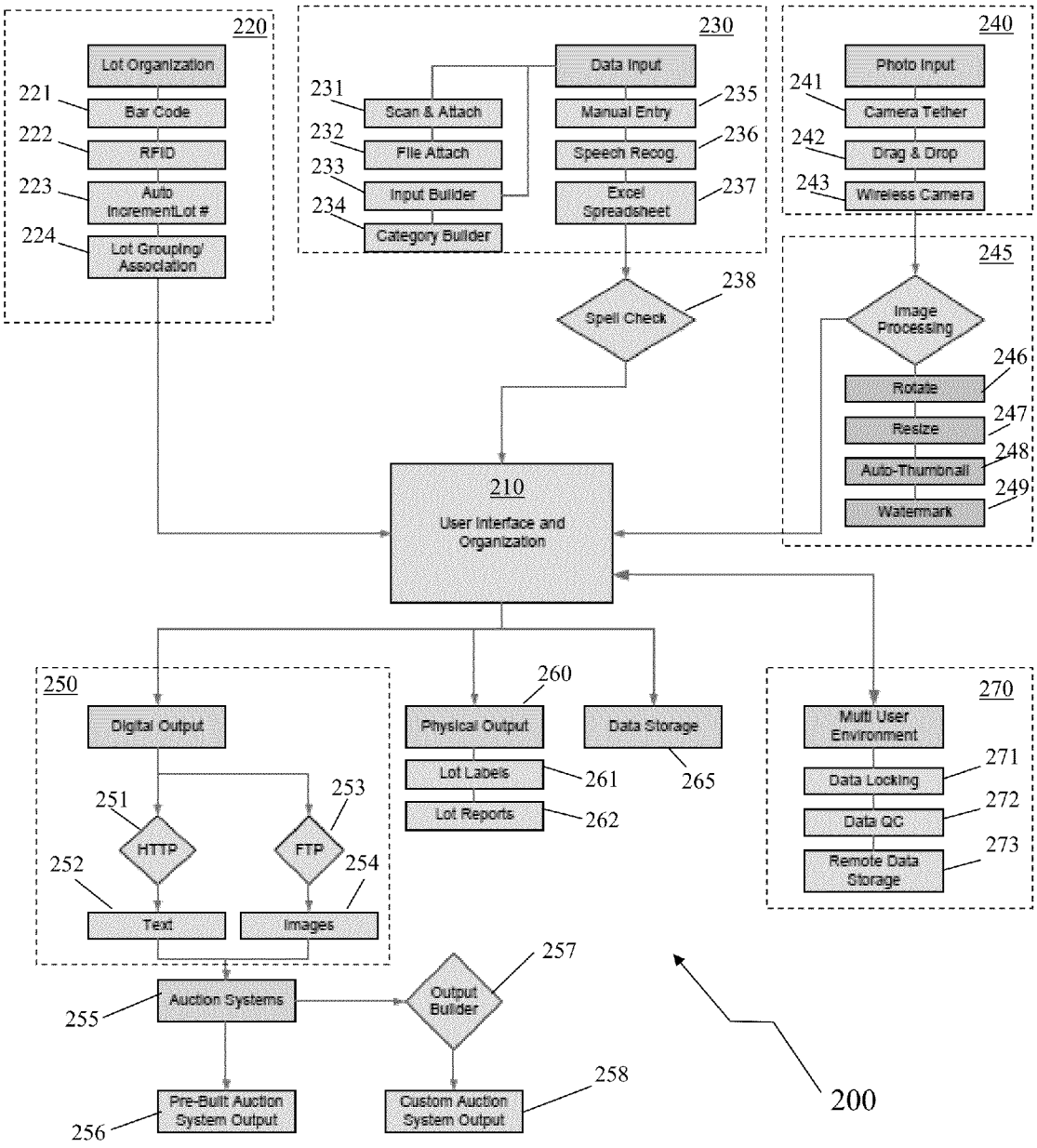
FIG. 2 is an overview flow chart of the various inputs and outputs available for a user interface and the organization thereof according to the illustrative embodiment.

FIG. 2 shows an overview of the data flow for the various inputs and outputs available for a user interface 210 and the general organization thereof as an overall procedure 200, according to the illustrative embodiment. The system includes asset or lot organization procedure 220, which enables a user to organize the particular lot, or group, of assets. A user can either submit or scan a bar code 221, use RFID 222 to obtain lot number, automatically increment the lot number 223 or use a lot grouping/association 224 for a particular lot. The system includes a data input procedure 230 in which a user can scan and attach pertinent data 231, attach a file 232, run an input builder 233 which determined the inputs, or a category builder 234 to further define the asset. The user can further perform manual entry 235 of asset data, or speech recognition 236 to ascertain asset information, and finally an excel spreadsheet 237 for gathering asset data. The data input then undergoes a spell check procedure 238 to ensure proper spelling of terms used, prior to being transmitted to the user interface 210.

There can also be provided a photo input procedure 240 for obtaining a photo corresponding to a particular asset. There can be provided a camera tethered to the device 241 for obtaining a photo, there can be a drag and drop feature 242 which allows photos taken from a peripheral device to be input, or a wireless camera 243 which wirelessly provides the photo of a particular asset. This photo is captured directly on the form to be provided with the other data corresponding to an asset. The photo then undergoes an image processing procedure 245 which can include the options to rotate 246, resize 247, auto-thumbnail 248 or watermark 249 the photograph, prior to the photograph being input to the user interface 210.

The user interface and organization 210 can provide a digital output 250, physical output 260 or perform data storage 265. The digital output of the user interface uses HTTP (hypertext transfer protocol) 251 for the text 252 of the output, and FTP (file transfer protocol) 253 for the images 254 of the output. The output is transmitted to appropriate output systems such as an auction, appraiser or catalog system 255. A pre-built auction system output 256 can be provided to display the user interface according to a particular predetermined output, or an output builder 257 can be employed to provide custom system output 258. The physical output 260 of the user interface can include lot labels 261 used to identify a particular lot of assets, and lot reports 262 can also be provided to report on the assets being lotted for a particular lot or specified group.

The system further provides for a multi user environment 270 of the user interface. According to the multi user environment, there can be conventional data locking techniques 271 enabled so that entries are not duplicative or multiplicative, and so that data is not inadvertently overwritten. Also, there can be data quality control 272 provided to monitor the quality of data being produced by the user interface. The multi user environment 270 also provides for remote data storage such that the system database need not be accessed for all pertinent data.

Figure 3:
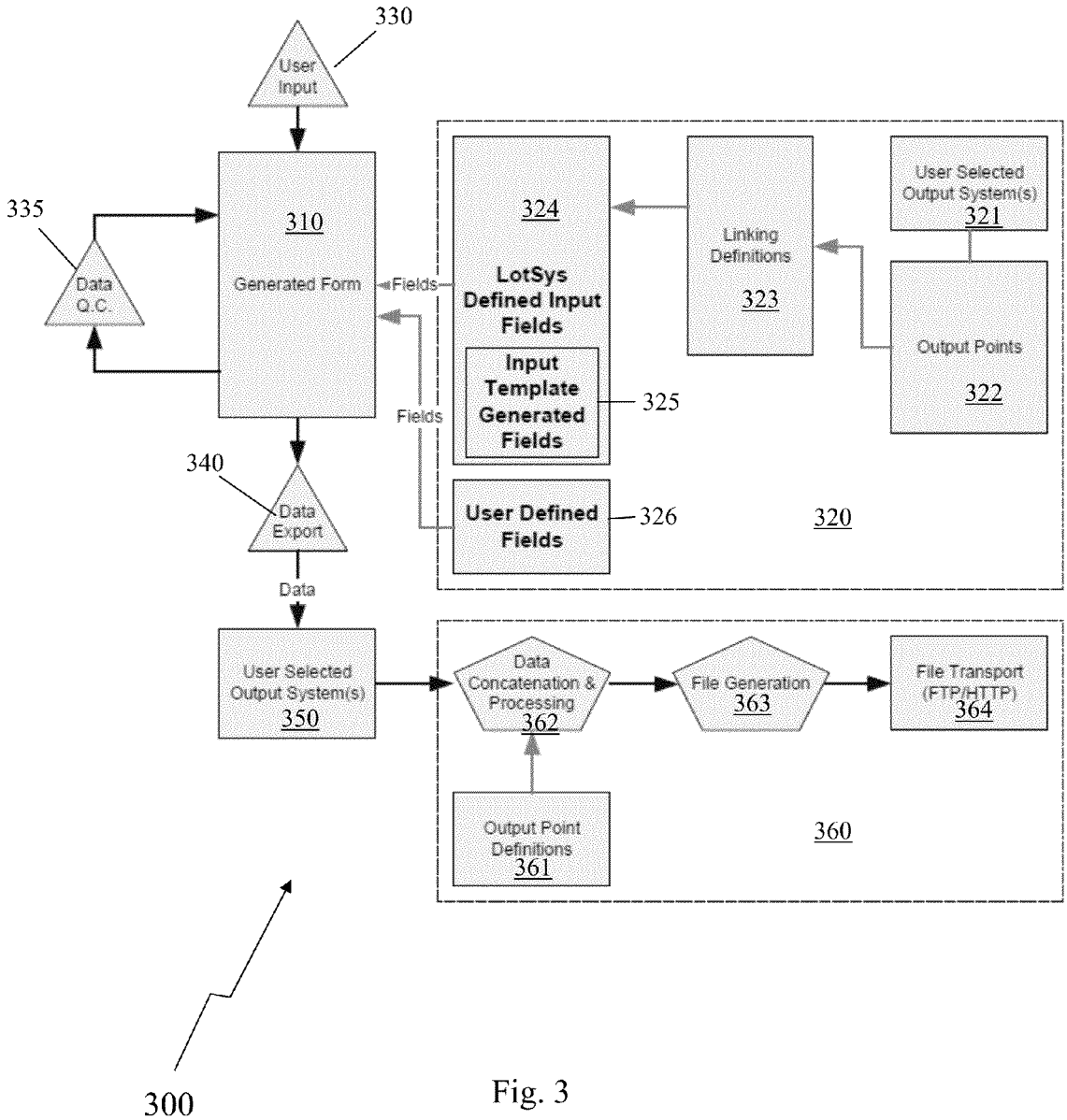
FIG. 3 is a flow chart of a form field generation procedure and overall data flow according to the illustrative embodiment.

Reference is now made to FIG. 3, showing a flow chart of a form field generation procedure 300 and overall data flow associated with file generation and providing a generated form 310. Fields are generated by a field generation procedure 320 which begins with user selected output system(s) 321 in which the user provides the asset type, which generates output points 322. The output points 322 are used to generate linking definitions 323 which provide the information desired for a particular asset. For example, different linking definitions are generated for a truck as compared to the linking definitions for a boat so that the linking definitions (and corresponding data fields) are specific to the type of asset for which data is gathered. Accordingly, the data fields generated for each template form are appropriate for (i.e. correspond to or are particularly relevant for) the particular asset, such that similar data fields are generated for assets having substantially similar characteristics For example, if a vehicle is selected, the data fields generated can include year, make, model, color, body style, number of doors, number of cylinders, condition, description, and the option to upload a photo, among other appropriate data fields. Other assets that fall within the type of "asset" as a vehicle have similar fields generated for data gathering. The vehicles can include cars, trucks, SUVs, minivans, or other assets appropriately falling within the category. In another example, when the asset is a piece of artwork such as a painting, the data fields can include year, description, size, estimated value, and the option to upload a photo, among other appropriate data fields. In this manner, assets having similar characteristics have the same data fields so that a standardized form is generated for each asset type and similar data is gathered for assets having similar characteristics. The system defined input fields 324 and input template generated fields 325 are generated from the linking definitions 323. These fields 324, 325, and additional user defined fields 326 are used to provide a generated form 310 having template data fields for entry in data gathering.

According to the illustrative embodiment, data is collected by the user via user input 330, such as a user interface as described herein, or other conventional data entry and gathering techniques. Data can undergo quality control 335 by an application running on the system server or as performed by an independent third party. Data export is performed at 340 to the user selected output system(s) 350, which provides the output to an interested individual. The output system(s) 350 is input to a file generation procedure 260 which generates output point definitions 361 used for data concatenation and processing at 362 for managing the asset data. The file is then generated 363 from the concatenated data, and the file is transported using the appropriate protocol (FTP/HTTP) 364 for communicating the asset data.

Figure 4:
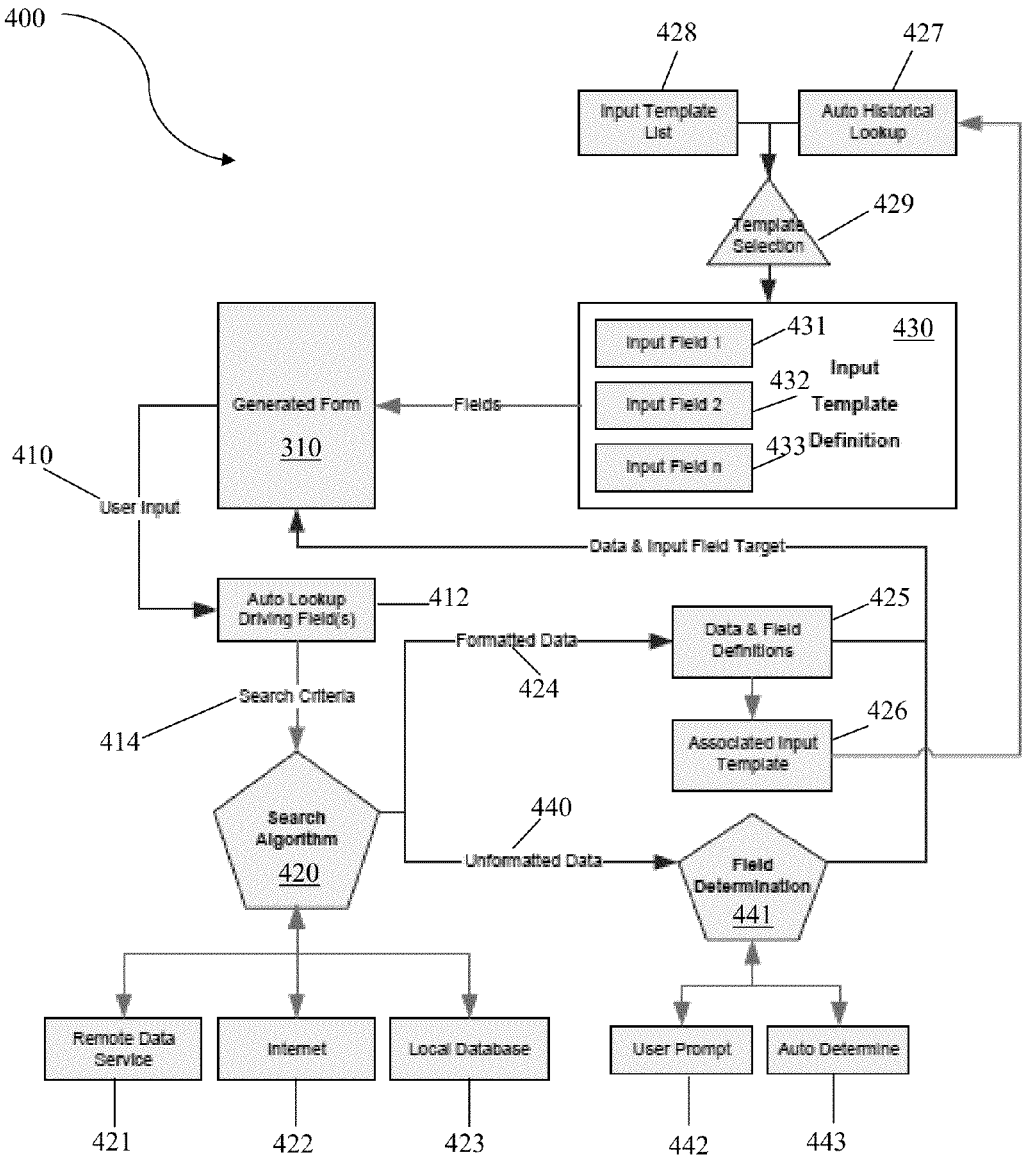
FIG. 4 is a more detailed flow chart of the input template selection procedure and form field generation procedure according to the illustrative embodiment.

FIG. 4 is a detailed flow chart of the procedure 400 for providing the input template and generating the form field. Note that the procedure allows for real-time form generation in response to the asset type as selected by a user. The generated form 310 is the result of the user selected output system (s), which determines the appropriate template form based on user output systems that define the type and characterization of the asset. User input 410 is provided into the generated form 310 which generates auto lookup driving field(s) 412, based upon the asset type. Search criteria 414 is entered, which can be data input into the form or specific search criteria. A search procedure 420 appropriately handles the user input to generate the fields for the generated form. The fields can be accessed by remote data service 421, the Internet 422, or a local database 423. For example, if a user inputs a painting as an asset for lotting or cataloging, the search application acquires appropriate input fields for a painting and then generates a form containing the appropriate input fields for data gathering, depending upon the particular asset selected.

Formatted data 424 from the search procedure 420 provides data and field definitions 425. These data and field definitions 425 are provided as data and input field targets for the generated form 310. An associated input template 426 can also be generated to provide multiple fields, by creating an auto historical lookup 427 in communication with an input template list 428. This results in a template selection at step 429 and then an input template definition process 420 which generates input field 1 (431), input field 2 (432), through to input field n (433). These input fields are used as fields for the generated form 310.

Unformatted data 440 from the search procedure 420 is transmitted to field determination step 441 which allows for user prompt 442 to allow the user to determine the field, or auto determine 443 for automatically determining the fields. Once these fields are determined, they are used as data and input field targets for the generated form 310.

Figure 5:
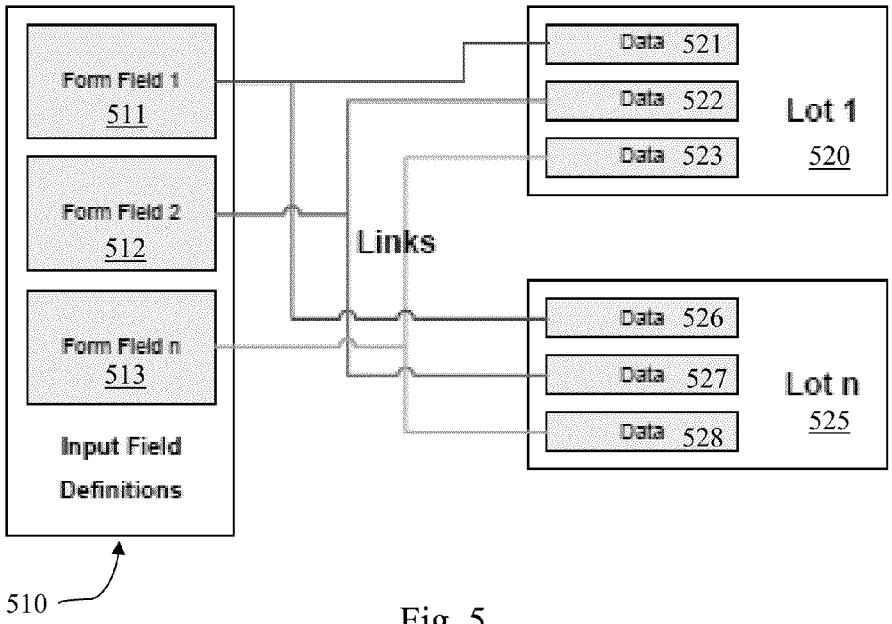
FIG. 5 is a schematic diagram of data storage between the input field definitions and a plurality of lots, according to the illustrative embodiment.

FIG. 5 shows a schematic diagram for performing data storage for a plurality of lots and corresponding input field definitions. According to the illustrative embodiment, a plurality of input field definitions 510 are provided. Form field 1 (511) corresponds to Data 521 from Lot 1 (520), and similarly to data 526 of lot n (525). Form field 2 (512) corresponds to data 522 from lot 1 (520) and similarly to data 527 of lot n (525). The data storage is similarly performs for all form fields through form field n 513 having corresponding data values 523 for lot 1 (520) and data 528 for lot n (525). As shown in the schematic, like data fields corresponding to like form fields are stored for each lot. In this manner, similar asset types have like form fields.

Figure 6:
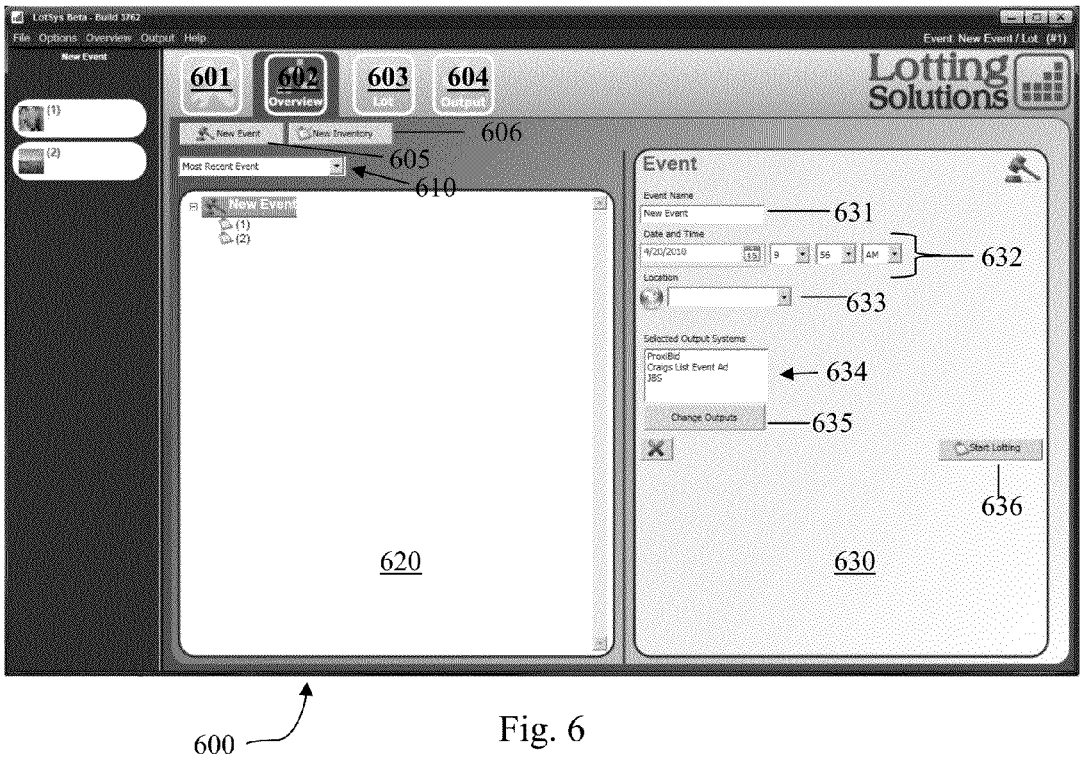
FIG. 6 is a diagram of an exemplary computer graphical user interface (GUI) display for an overview screen of an interactive portal, according to the illustrative embodiment.
Figure 7:
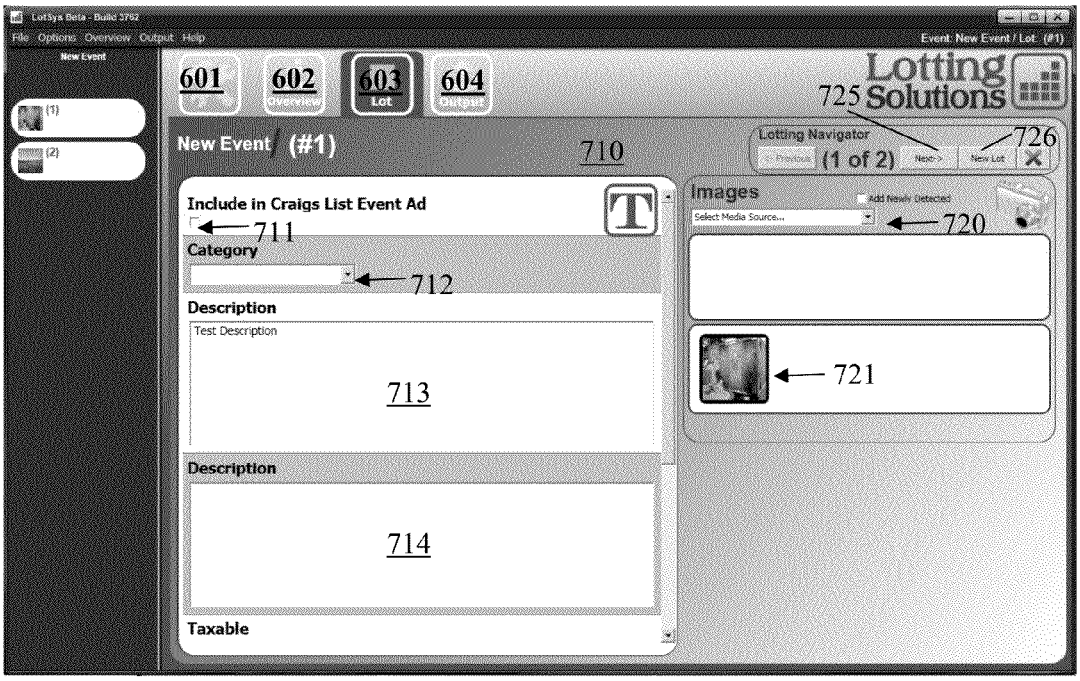
FIG. 7 is a diagram of an exemplary GUI display for a lotting screen of the interactive portal, according to the illustrative embodiment.
Figure 8:
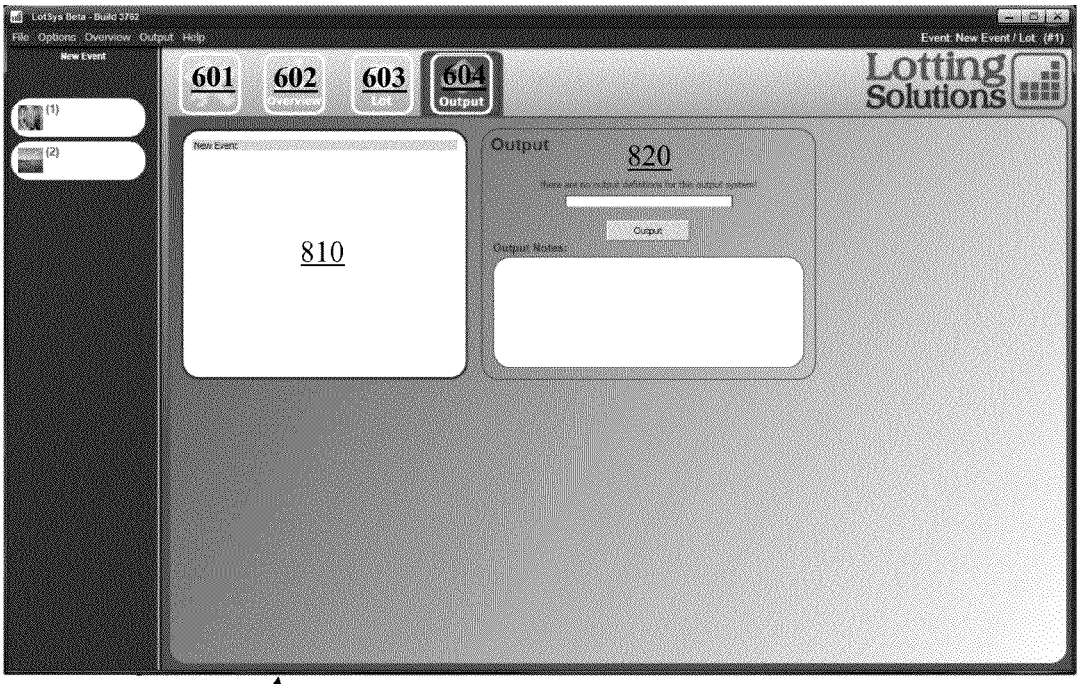
FIG. 8 is a diagram of an exemplary GUI display for an auction output screen of the interactive portal, according to the illustrative embodiment.

Reference is now made to FIGS. 6-8 showing diagrams of exemplary browser screen displays for an interactive portal for managing asset data, in accordance with an illustrative embodiment. The diagrams of exemplary browser screen displays of FIGS. 6-8 can be displayed as conventional browser screen displays on a website portal, or screens provided in an application running on a device, such as a laptop computer, a tablet computer, various data collection devices, an iPhone, BlackBerry, or other smart phone or appropriate displaying device. In an illustrative embodiment, during operation upon entering log-in credential to access the interactive portal (not shown), a user is directed to the diagram of an exemplary screen display 600 of FIG. 6. According to the illustrative embodiment, there is included an "options" tab 601, "overview" tab 602, "data gathering" tab 603 and "auction output" tab 604. These exemplary tabs, including their title, location, stylistic and other features, are highly variable and can be modified as apparent to those having ordinary skill in the art, without departing from the features and functions of the user interface and associated hardware and software components as described herein for managing asset data. For example, the "tabs" can be replaced with a selection box, a drop down box, a hyperlink or other appropriate element. The "options" tab 601 (or "preferences" or another appropriate tab in other embodiments) allows a user to set the process flow and the image flow manipulations for a particular template or form field. Selecting the "overview" tab 602 generates the organization screen 620 which lists the events. The "overview" wording on the tab 602 can be replaced with the title of the specific event, such as "Auctions" or "Foreclosures" or other titles readily apparent to those ordinarily skilled in the art.

In operation, a user can select "New Event" button 605 to enter data for a new event, which populates the event screen 630. The user can also select "New Inventory" button 606 to review and edit new inventory corresponding to a particular auction or for assets that will be assigned to an auction in the future. The drop-down box 610 allows a user to select the particular event to be viewed in the organization screen 620. Although not shown, it should be readily apparent that there can be multiple inventories collected and multiple cataloging events within the solution.

The event screen 630 generated by selecting the "New Event" button 605 provides a user with various inputs to identify the particular event and its attributes. Illustratively, an "Event Name" text entry box 631 is provided to input the name of the event. Further, a date and time entry drop-down box 632 is provided to select the event date and time, as well as a location drop-down box 633. There are several options for the event entry screen that are determined by and vary depending upon the outputs that are selected by lotter or auction company.

According to the illustrative embodiment, the user selects the various output systems in box 634, and selecting the "Change Outputs" box 635 results. The selected exports determine the selected attributes of data that will be collected for the Event as well as drive what will appear on 'lotting screen form". Selections include or can include calendars, which are public auction calendars where auctioneers advertise their respective auctions and relevant attributes like dates, times, assets for sale, representative images, etc. Other selection options include advertising sites as the CRAIGSLIST® example, brochure development programs for creating brochure for mailing or web advertising, auctioneer's auction software for running the auction, a third party on-line auction provider where data export is a different format from auction software, but all lots must be identical with some subsets of different data elements driven by requirements of various systems. The template procedure creates multiple exports that are loaded into various disparate systems. A user, upon entering an auction event information and export selections, can commence lotting the assets by selecting the "Start Lotting" button 636. This functionality also enables ability for complete catalog descriptions and images to be loaded to various websites for detailed marketing and publicizing of each asset being cataloged for sale providing for Search engine optimized data to be shown in search results on various public sites like Google or Bing or Yahoo.

Once a user determines to start "lotting or cataloging", by gathering data, they are directed to a lotting screen, for example the exemplary browser screen display 710 as shown in FIG. 7 according to an illustrative embodiment. The lotting screen form is automatically created and accounts for all attributes desired for the previously selected output systems. For example, if a different auction system is selected, the lotting screen may be different because different data elements may be required to be collected by lotter. This screen can also be accessed by selecting the "lot" tab 603. Illustratively, the user is provided with a check-box 711 to determine whether to include the asset in a CraistList® Event Ad. Other selected outputs such as calendar and brochure "check box" would indicate which sample lots would be exported for these various systems. A user can select the particular category for the asset using the drop-down box 712. Once the category is selected, form fields (not shown) are generated to gather particular data for an asset. This can be written into the text entry box 713 which is displayed as a description in box 714. The screen 710 also includes an images section for selecting the media source from the drop-down box 720 for acquiring an image of the asset such that the acquired images 721 are displayed. There is also provided a lotting navigator which allows a user to view the next asset by clicking the box 725 or select a new lot by selecting the box 726.

According to the illustrative embodiment, once a user has entered data for a particular asset, the user is directed to an output screen as shown in FIG. 8. This screen can also be accessed by selecting the "output" tab 604. The event data is provided in screen 810 and output for the auction is listed in screen 820. The outputs are not shown for this particular embodiment, as they have not been selected. However, the outputs are available for a user to view in the output screen 820 and should be known to those having ordinary skill in the art. Although not shown, an "Import" tab can also be provided for the user interface display to allow users to import and/or upload various files according to conventional techniques, such that the files can be included in the forms and/or stored in the asset database.

The online portal, in communication with the system server and system database, provides users, including auctioneers and lotters, with a mechanism for effective and efficient management of lotting data. The system provides standardized forms containing similar data fields for similar type assets, to provide uniform data collection for a particular auction event. It should be apparent to those having ordinary skill that the illustrative screen displays provide an exemplary arrangement of elements and are for illustrative and descriptive purposes. Other and varying arrangements of the elements, including the order, type, style, words used, location of functions, individual screens, tabs, boxes, drop-down boxes, and other conventional elements are highly variable.

The teachings herein are readily applicable to other industries and practices, without departing from the scope of the invention. For example, in the financial aspect of real estate. Banks lending against assets could use the system to obtain important information and required information for a particular asset they are lending against. The bank can assign lotters or catalogers to perform the acquisition of data, or can be performed by independent third party auditors. Also, the system is applicable for leasing companies having a plurality of vehicles. They can monitor their vehicles and other assets, including trucks, forklifts, IT equipment, or other assets, and the information corresponding to the asset can be attached, for example, to the invoice. The system can further be provided to create a running history of particular assets, so that the assets can have a log of usage and other pertinent data corresponding thereto.

The system can also be applicable for auditors, so as to provide an improved system for gathering and managing data corresponding to an asset. In an auditor arrangement, there can be local data and image acquisition, and a central database can be provided to aggregate the data.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the teachings, herein, while performed by a plurality of networked computers in a client-server environment, a variety of data processing arrangements, including wireless arrangements and distributed computing environments (in which some or all of the computing and/storage tasks are carried out by local clients) can be employed in alternate embodiments. Likewise, any of the processes described and/or contemplated herein can be implements using hardware, software, including a computer readable medium of program instructions, or a combination of hardware and software. Accordingly, this description is meant to be taken only by way of example, and not to otherwise limit the scope of this invention.

What is claimed is:

1. A system for managing data for assets, the system comprising:

a system server having a plurality of applications executing thereon, including at least one input template procedure, to determine input data fields for at least one of the assets, based, at least in part, on a category of the at least one of the assets, so as to generate a form with a form generator, the form containing the input data fields for the category, the input data fields being specific to, and particularly relevant for, the category, wherein the at least one input template procedure includes an output point generator that receives at least one user-selected output system accessible by a user, from a plurality of output systems, on which data entered via the input data fields is to be displayed, the output point generator, generates output points specific to the selected at least one output system, wherein the at least one input template procedure further includes a linking definition generator that, based upon the output points generates linking definitions specific to the category, wherein the at least one input template procedure further includes an input data field generator that generates the input data fields to contain in the form based upon the linking definitions;

a system database in communication with the system server that stores each form corresponding to each category, respectively; and wherein the at least one input template procedure generates a plurality of data exports that the user selects to load on each of the plurality of output systems.

2. The system of claim 1 further comprising an online portal in communication with the system server to access and provide lotting data relating to an auction.

3. The system of claim 1 wherein the input data fields include a lot number, a sale order number, an asset number, a lot title, a category designation, a description, a quantity, a price, an appraisal, and a photograph.

4. The system of claim 1 wherein the form includes a photograph related to the asset.

5. The system of claim 1 wherein the assets are for an auction event and the data fields include information particularly related to the auction event.

6. The system of claim 1 wherein the assets are for cataloging assets having substantially similar characteristics and the input data fields are related to the cataloging of assets.

7. The system of claim 1 wherein the asset is a vehicle and the input data fields include make, model, year, color and mileage.

8. The system of claim 1 wherein the asset is a piece of artwork and the input data fields include year, author, description and size.

9. The system as set forth in claim 1 further comprising a system defined field generator that, based upon the linking definitions, provides system defined fields to the form.

10. The system as set forth in claim 9 further comprising user defined fields that are contained within the form.

11. The system as set forth in claim 1 wherein output system includes a search procedure that searches data sources based upon auto lookup driving fields to generate at least one of the input data fields.

12. The system as set forth in claim 11 wherein the data sources include at least one of a remote data service, a local database and Internet.

13. The system as set forth in claim 11 wherein the search procedure provides at least one of formatted data and unformatted data, the formatted data providing at least one of (a) data and (b) at least one input field target for use in the form.

14. The system as set forth in claim 13 further comprising a field determining procedure that prompts the user with the unformatted data and based upon user input generates at least one of (a) data and (b) an input field target for use in the form.

15. A method for managing lotting or catalog data comprising:

receiving an asset type to identify the type of asset for which related data is gathered;

providing a plurality of input data fields corresponding to the asset type, generated by a template procedure running on a system server, and generating a form containing input data fields corresponding to the asset type, the input data fields being specific to, and particularly relevant for, the asset type, wherein the step of generating includes;

receiving at least one user-selected output system accessible by a user, from a plurality of output systems, on which data entered via the input data fields is to be displayed, and in response to the step of receiving, generating output points specific to the selected at least one output system, based upon the output points, generating linking definitions specific to the asset type, generating the input data fields to contain in the form based upon the linking definitions;

uploading the form to a system server for management of the data related to the asset; and providing, with the step of generating, a plurality of data exports, the user selecting the data exports to load on each of the plurality of output systems.

16. The method of claim 15 wherein the input data fields are generated by matching the asset type to an input template.

17. The method of claim 15 wherein the asset type is received from a user operating at a remote device as the output system.

* * * * *